United States Patent [19]

Eng et al.

[11] 4,280,342

[45] Jul. 28, 1981

[54] PROTECTIVE PAD OR GARMENT FOR THE HUMAN BODY OR PARTS THEREOF

[75] Inventors: Kjell Eng, Mullsjö; Anders G. Bengtsson, Borås, both of Sweden

[73] Assignee: AB Aiser, Borås, Sweden

[21] Appl. No.: 13,445

[22] Filed: Feb. 21, 1979

Related U.S. Application Data

[63] Continuation of Ser. No. 841,887, Oct. 13, 1977, abandoned.

[30] Foreign Application Priority Data

Oct. 14, 1976 [SE] Sweden ..... 7611393

[51] Int. Cl.[3] ..... A41B 9/02; D04B 7/04

[52] U.S. Cl. ..... 66/177; 66/202; 66/196; 2/2; 2/22

[58] Field of Search ..... 66/87, 169, 202, 196, 66/193, 191; 2/46, 59, 61, 62, 2

[56] References Cited

U.S. PATENT DOCUMENTS

| | | | |
|---|---|---|---|
| 671,059 | 4/1901 | Sanders | 2/231 |
| 727,243 | 3/1903 | White | 2/231 X |
| 738,677 | 9/1903 | Hammond | 2/231 |
| 2,601,771 | 7/1952 | Cameron | 66/202 X |
| 3,221,520 | 12/1965 | Bassist | 66/87 |
| 3,305,911 | 2/1967 | Chapman et al. | 66/202 X |
| 3,646,782 | 3/1972 | Kohl | 66/87 |
| 3,864,944 | 2/1975 | Jackson | 66/87 |
| 4,035,844 | 7/1977 | Atack et al. | 2/227 X |

*Primary Examiner*—Ronald Feldbaum

*Attorney, Agent, or Firm*—Harness, Dickey & Pierce

[57] ABSTRACT

A protective pad or garment for use as a guard against injuries to the human body or parts thereof, incurred e.g. from saw blades or other sharp tools. The pad is made from a double-knit warp fabric of a synthetic material, the two layers of which are interconnected by pile threads, preferably consisting of polypropylene foil strips, which pile threads in at least one of said layers form meshes with the threads of another thread system, or with themselves. The resulting pad comprises a large number of the pile threads which by their nature and their bond to the mesh layer closest to the body resist the cutting effect of the saw blade or other sharp tool that may penetrate through the outer mesh layer.

8 Claims, 5 Drawing Figures

PROTECTIVE PAD OR GARMENT FOR THE HUMAN BODY OR PARTS THEREOF

This is a continuation of application Ser. No. 841,887, filed Oct. 13, 1977, now abandoned.

BACKGROUND OF THE INVENTION

Sawyers working with power saws within the wood processing industry are liable to injuries. In order to reduce the effects of such injuries to the body of the sawyer, particularly to his legs, various kinds of protective means have been developed, particularly leg-guards. The most common leg-guard is a pad consisting of 20 layers of a thin knitted nylon fabric which is secured to the trouser legs. Also pads of synthetic fur, i.e. a single pile thread fabric are available.

The purpose of the leg-guard is to prevent the saw-blade from cutting through, i.e. to oppose the effect of the saw teeth during the sawyer's reaction time, i.e. the time he needs to stop or divert the saw-blade away from the part of the body covered by the guard. The guard must also be able to resist the force of impact of the cutting bar against the guard.

Saw guards made from synthetic pile fur have proved unsatisfactory since the threads of the fur fabric are pushed apart by the saw teeth and therefore fail to offer sufficient resistance but instead allow the saw-blade to cut through the protective pad comparatively quickly. Saw guards or protective pads consisting of a large number of layers of a synthetic knitted fabric are rigid and also comparatively expensive to manufacture, as each layer must be produced separately and the individual layers thereafter sewn together.

SUMMARY OF THE INVENTION

The subject invention concerns a pliant guard or protective pad which is easy to manufacture and constitutes a very efficient protection means. The invention is characterised in that the guard or pad consists of a double-knit warp fabric of a synthetic material the two knitted layers of which are interconnected by pile threads in such a manner that these pile threads, at least in one layer, form meshes together with the threads from another thread system.

The invention is based on the realization that the two mesh layers which are interconnected by the pile threads result in a relatively elastic and pliant fabric. When the cutting bar of a power saw hits the guard, the teeth of the saw chain tear up the outer mesh layer at the point of impact and bend the pile threads underneath backwards, i.e. in the direction of movement of the saw chain. Because the pile threads are kept together by the meshes and therefore cannot move apart, forming between them gaps and channels into which the saw teeth may easily penetrate, as is the case in single pile thread fabrics, the saw is forced to work itself through the pad. Some of the pile threads are damaged and town away but as the saw teeth interstices are gradually filled up with threads, the teeth will slide on the pile threads and on the lower mesh layer - the one closest to the body to which the pile threads are anchored by their inner ends. Before the guard is entirely sawn through, the sawyer will have had sufficient time to react and either stop the saw or divert it away from the leg-guard.

BRIEF DESCRIPTION OF THE DRAWINGS

Further characteristics of the invention will appear from the following description with reference to the annexed drawings, wherein.

DETAILED DESCRIPTION OF A PREFERRED EMBODIMENT

Figure 3:
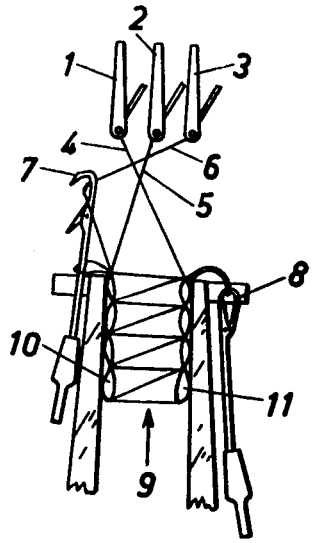
FIGS. 3 and 4 illustrate schematically a part of a warp knitting machine intended for the manufacture of warp knit fabrics to be used as protective pads or garments in accordance with the invention.

FIG. 3 illustrates the manner in which a double-knit warp fabric 9 is made from threads 4, 5, and 6, supplied by yarn guides 1, 2, and 3, with the aid of latch needles 7 and 8. The pile thread 5 forms meshes 10, 11 both with threads 6 and with thread 4.

Figure 2:
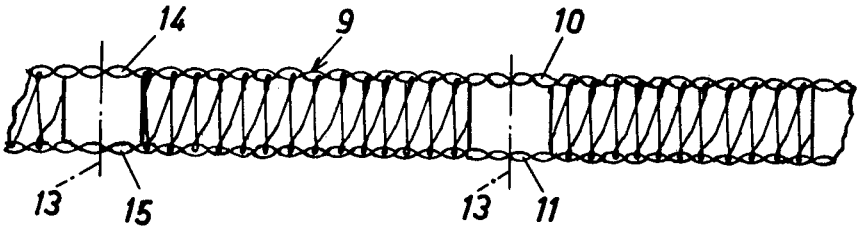
FIG. 2 is a cross-sectional view through a double-knit warp fabric from which the leg-guard of FIG. 1 is taken.
Figure 1:
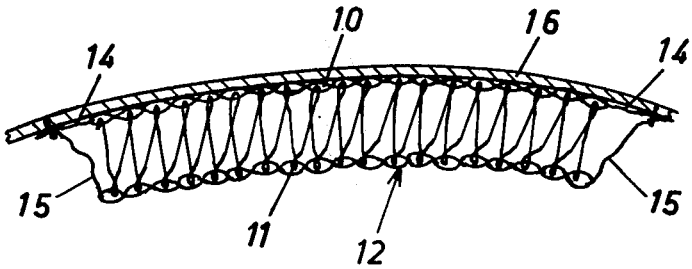
FIG. 1 is a cross-sectional view through a leg-guard in accordance with the invention, applied on a trouser leg.

FIG. 2 illustrates how the desired width of the guard or pad 12 is obtained in the production of a warp knit fabric 9 in the machine illustrated in FIG. 3 by interruption at desired intervals of the feed of the pile thread 5 while the rows of meshes 10, 11 are continuously formed by threads 4 and 6. The guards or pads 12 are divided from the knit fabric along the cutting lines 13 indicated in FIG. 2. In this manner, the mesh layer of the guard is given free marginal portions 14, 15 by means of which the guard or pad 12 can easily and conveniently be sewn onto a trouser leg 16.

The knit fabric may be manufactured in a raschel loom or warp frame loom of any known kind. The knitting pattern is independent of the invention.

Figure 4:
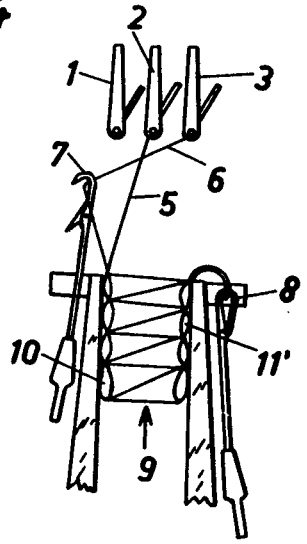
Figure 5:
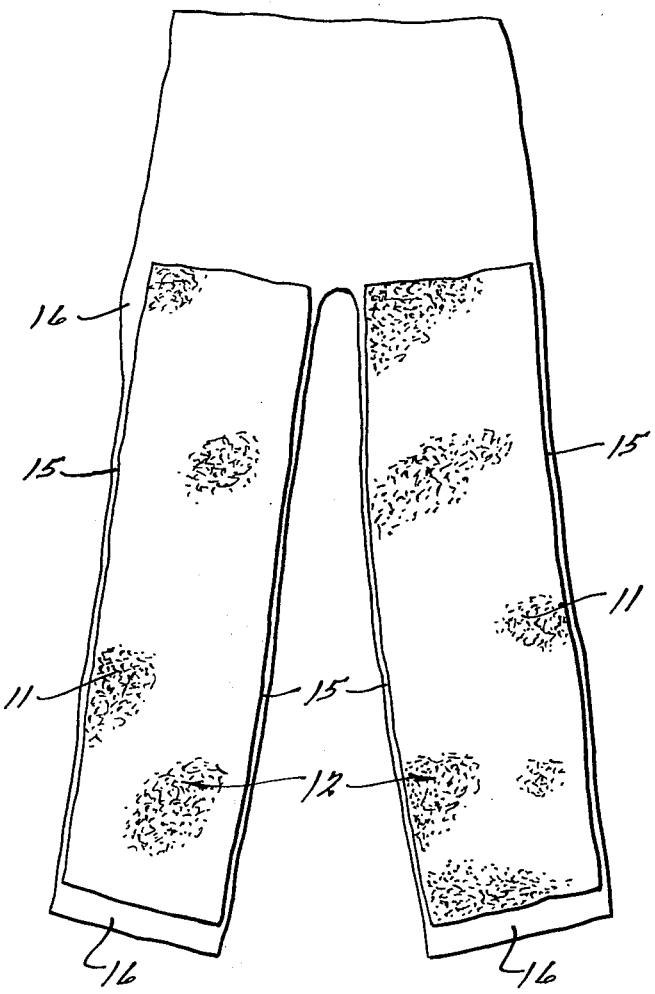
FIG. 5 illustrates the protective garment of the invention.

As illustrated in FIG. 4, it is possible to knit the fabric in such a manner that meshes 10 as in accordance with the embodiment illustrated in FIG. 3, are formed on one side of the fabric by threads 6 and 5 whereas on the opposite fabric side meshes 11' are formed only by pile thread 5.

The material of the threads 4 and 6 preferably is made from nylon monofilaments having a thickness of 40 deniers. The pile threads may consist of spun materials of a thickness of Nm 9, but preferably they may be made from a foil of a synthetic material, particularly polypropylene, which is divided into strips having a thickness of appr. 0.1 millimeter and a width of appr. 2 millimeters. The advantage of using strips of this kind as the pile thread material is that they are rather smooth, with the result that the saw teeth, when they bite into the guard or pad and have cut through the outer mesh layer, i.e. the one designated 11' in FIG. 4, slide and slip on the strips which are bent backwards by the saw chain but are still retained to the bottom mesh layer—the one closest to the body (left one in FIG. 4)—by one end, whereby complete cut-through of the saw teeth through the guard or pad is prevented.

The fabric should be knitted so as to ensure that the number of pile threads in the fabric is appr. 50 per square centimeter. A suitable thickness of the fabric, i.e. the distance between the mesh layers, is between 15 and 22 millimeters, preferably about 18 millimeters.

As indicated above, the large number of pile threads extending between the two knitted yarn layers, is important for the efficiency of the pad as an efficient guard, because it is along the pile threads that the saw chain teeth slide when they have cut through the outer yarn layer which faces away from the body. In this position, the pile threads are still joined to that yarn layer of the knitted warp fabric that faces the body, and thus these threads are still anchored to the yarn layer closest to the body. It is precisely this fact that makes the pile threads such an excellent protection to the part of the body that the pad is intended to protect. The sawyer is given sufficient time to react and to divert the saw before the saw teeth cut through the pile threads as well as the inner yarn layer at the area of impact.

The pad in accordance with the subject invention also has the added advantages of being pliant enough not to impede the movements of the user and air-permeable enough not to be uncomfortable when worn in hard physical work or in warm surroundings. The guard or pad in accordance with the subject invention therefore is suited for protection for other parts of the body beside the legs, such as the hands or arms, and may of course be used for many other operations within the industry besides sawing operations. The pliability and air-permeability of the guard in accordance with the subject invention likewise makes it well suited for use as lining in garments or equipments worn by sportsmen who are liable to damages from impacts, such as rugby, hockey, ice-hockey, lacrosse players, footballers, etc. In this case the knitted warp fabric may be thinner.

The embodiments as described and illustrated are to be regarded as examples only and a variety of knitting patterns known per se may be used.

What we claim is:

1. In combination with a garment having trouser legs for covering the legs of a person operating a saw or the like, a protective pad attached to one of said trouser legs to be in protective relationship to an associated leg of said person covered by said trouser leg, said protective pad comprising a double-knit warp fabric of synthetic material having two layers of fabric being joined together by connecting threads, said connecting threads being sufficient in number and said layers being spaced a sufficient distance apart that said connecting threads will fill the gaps between the teeth of a saw severing the outermost of said layers and slow down the cutting action of the saw to permit said person to protect said leg before being cut.

2. The combination of claim 1 wherein said connecting threads form meshes with themselves in order to form the one of said two layers of the double-knit fabric adapted to be closest to said associated leg of said person.

3. The combination of claim 1 wherein said connecting threads are formed from strips of polypropylene.

4. The combination of claim 6 wherein said connecting threads are formed from strips of polypropylene.

5. The combination of claim 4 wherein said layers are spaced apart a distance of from about 15 mm to about 22 mm.

6. The combination of claim 5 wherein each of said strips of polypropylene have a thickness of about 0.1 mm and a width of about 2 mm and the number of connecting threads is about 50 per square centimeter.

7. The combination of claim 1 wherein said protective pad is sewn as lining in said one of said trouser legs.

8. The combination of claim 7 wherein said pile threads are made of polypropylene.

* * * * *